United States Patent [19]

Minami

[11] Patent Number: 4,495,442

[45] Date of Patent: Jan. 22, 1985

[54] COLD-CATHODE MAGNETRON INJECTION GUN

[75] Inventor: Kazuo Minami, Kawasaki, Japan

[73] Assignee: Tokyo Institute of Technology, Tokyo, Japan

[21] Appl. No.: 415,465

[22] Filed: Sep. 7, 1982

[30] Foreign Application Priority Data

Sep. 17, 1981 [JP] Japan ..... 56-145478

[51] Int. Cl.[3] ..... H01J 23/16; H01J 29/96

[52] U.S. Cl. ..... 315/3; 313/442; 313/454; 313/336; 315/5.29

[58] Field of Search ..... 315/5.29, 5.31, 5.39, 315/3; 313/442, 454, 455, 336; 328/233

[56] References Cited

U.S. PATENT DOCUMENTS

| | | | |
|---|---|---|---|
| 3,258,626 | 6/1966 | Kino et al. | 313/455 |
| 3,315,110 | 4/1967 | Chen Wang | 313/455 |
| 3,344,398 | 9/1967 | Martin | 313/57 |
| 3,345,528 | 10/1967 | Bryant, Jr. | 313/455 |
| 3,506,866 | 4/1970 | Poschl et al. | 315/3.5 |
| 3,700,945 | 10/1972 | Friedman et al. | 315/5.39 |
| 3,706,002 | 12/1972 | Miram et al. | 315/5.39 |
| 3,919,580 | 11/1975 | Mooney et al. | 313/336 |
| 4,038,602 | 7/1977 | Friedman | 328/233 |

OTHER PUBLICATIONS

M. Friedman and M. Ury, "Production and Focusing of a High Power Relativistic Annular Electron Beam", The Review of Scientific Instruments, vol. 41, No. 9, Sep. 1970, pp. 1334–1335.

W. E. Waters, "A Theory of Magnetron Injection Guns", IEEE Transaction on Electron Devices, Jul. 1963, pp. 226–234.

*Primary Examiner*—Saxfield Chatmon

*Attorney, Agent, or Firm*—Spencer & Frank

[57] ABSTRACT

A magnetron injection gun comprising a conical cold-cathode and a cylindrical anode coaxially surrounding the cold-cathode. The anode is provided with an annular projection extending toward the emission ring surface, and the surface of the conical cold-cathode is coated with an insulating film, except for a portion opposite the end of the annular projection, which forms a conductive emission ring.

3 Claims, 22 Drawing Figures

1cm

COLD-CATHODE MAGNETRON INJECTION GUN

BACKGROUND OF THE INVENTION

1. Field of the Invention

This invention relates to a cold-cathode magnetron injection gun, and more particularly to a magnetron injection gun having a cold-cathode for instantaneously generating a high-power electron beam with an electron current of larger than 100 A, a duration of longer than 1 microsecond (preferably 1 to 10 microseconds), and a beam energy of larger than 100 keV, for the purpose of generating high-power pulsed electron beams or field emission electron beams. The invention intends to provide a magnetron injection gun which is suitable for application to a high-power mm microwave oscillator, a high-power X-ray generator, a high-intensity laser beam generator, a high-intensity neutron beam generator, and the like.

2. Description of the Prior Art

Principles of a magnetron injection gun using a hot cathode were disclosed by W. E. Waters in IEEE Transaction on Electron Devices, July 1963, pages 226–234. This hot-cathode magnetron injection gun uses a conical anode and a conical cathode coaxially disposed relative to each other, and a uniform static magnetic field is applied in the axial direction of the anode and the cathode, so that electrons emitted from the cathode are prevented from reaching the anode and such electrons are extracted and used as an electron beam proceeding in the axial direction. In this magnetron injection gun, the voltage to be applied across the anode and the cathode can be low, e.g., 200 to 250 V, and a direct current beam can be extracted continuously, but the magnitude of the electron beam extracted is usually restricted to be less than several amperes because the electron beam is emitted from the hot-cathode. The reason for this restriction is that, with the hot-cathode magnetron injection gun, even if production of an electron beam of larger than several amperes is tried by increasing the static magnetic field applied from the outside and increasing the electric field at the cathode to 100 kV/cm or higher, the high electric field intensity of the electron emitting zone quickly deteriorates the function of the hot-cathode because the cathode is heated by a heater, and emission of electrons becomes impossible.

On the other hand, U.S. Pat. No. 3,344,298 of J. C. Martin et al. disclosed a diode for generating electron beams. This diode generates a pulsed beam in the form a relativistic electron beam (REB) with a power of $10^9$ to $10^{12}$ W, which beam is produced by applying high-voltage short-duration pulses (duration being shorter than 100 nsec) to a low-resistance planar diode having an accelerating anode disposed in the beam passage at right angles, the accelerating anode being a metallic thin film or a foil shaft. However, such electron beam diodes of the prior art have the following shortcomings.

(1) The anode foil is susceptible to breakage by the electron beam passing therethrough.

(2) Collision with foil atoms tends to cause scattering of electrons.

(3) Arcs generated in the diode zone tend to cause gas emission from the foil and contamination of the system.

Due to the above-mentioned shortcomings, the application of the REB diode has been limited.

M. Friedman et al. have proposed to develop a foil-less REB diode for generation of high-power annular REB without using any foil or screen as the accelerating anode which has been used in the prior art, as disclosed in The Review of Scientific Instruments, September 1970, pages 1334 and 1335 with FIG. 1.

In this proposal, a high-voltage pulse of the order of 700 kV is applied to the foil-less diode during the peak of the magnetic field with a duration of $50\times10^{-9}$ sec., so that electrons emitted from a cathode are guided by magnetic field surrounding the cathode and formed into an annular relativistic beam extending in an axial direction. Beam generators using such foil-less diodes have shortcomings in that the magnitude of the high-voltage pulse to be applied to the cathode is too high so that the running cost becomes very high, and that the duration of emission being $50\times10^{-9}$ sec. is too short and the field of application thereof is limited.

In the electron beam generated by the magnetron injection gun, the velocity of the individual electrons is close to the velocity of light, so that relativistic treatment is necessary. The electron beam generator of such relativistic electron beam (REB) is apparently different from conventional electron accelerators and is used in different fields.

For instance the REB can be applied to nuclear fusion, such as drivers for inertia nuclear fusion, electron guns for heating of and injection to linear plasma, formation of inverse magnetic field orientation for stabilizing plasma by REB ring beam, and the like. Besides, the REB generator can be applied to a laser generator, an X-ray generator, a neutron beam generator, a microwave generator, an ion accelerator, and the like. Thus, the REB generator is used in a wide range of fields and has been actively studied in recent years.

SUMMARY OF THE INVENTION

Therefore, an object of the present invention is to obviate the above-mentioned shortcomings of the prior art by providing an improved cold-cathode magnetron injection gun. The magnetron injection gun of the invention can generate, for instance, electron beams whose intensity is ten times or more that generated by a conventional hot-cathode magnetron injection gun and whose duration is 1 to 10 microseconds which is more than one hundred times that generated by the above-mentioned conventional foil-less REB diode. The novel features of the invention are as follows.

(1) A cold-cathode is used in the magnetron injection gun, instead of a hot-cathode.

(2) Since the application of the same voltage as that for the hot-cathode to the cold-cathode will not cause electron emission, and an electric field intensity of 100 kV/cm or higher is applied to the cold-cathode so as to generate an electron beam having an electron current of several hundred amperes, a duration of at least one to several microseconds and a beam energy of 100 keV or more are obtained.

(3) Due to the use of the cold-cathode instead of the hot-cathode, a high-power electron beam cannot be generated continuously, but the magnetron injection gun of the invention increases the magnitude of the current by at least ten to one hundred times and ensures a beam duration of one to several microseconds which is more than one hundred times that generated by the conventional foil-less REB diode. Thus, the magnetron injection gun of the invention generates high-power pulsed electron beams with a large electron current of several hundred amperes and the above-mentioned duration, i.e. with an electron beam density of more than 100 A/cm$^2$, whereby high-power pulsed beams which have not been available heretofore are provided for various industrial applications.

To fulfill the object, the cold-cathode magnetron injection gun according to the present invention is characterized by comprising a vacuum container, an insulating holder extending from sidewall of said vacuum container toward the inside thereof, a conductor airtightly secured to said insulating holder so as to extend from the outer surface of said vacuum container to the inner end of said insulating holder, a conical cold-cathode secured to the inner end of said insulating holder and connected to the inner end of said conductor, the apex of said conical cathode extending away from said conductor, a cylindrical anode secured to said insulating holder so as to coaxially surround said conical cathode, a lead wire airtightly secured to the sidewall of said vacuum container so as to extend from the outer surface of said vacuum container to said cylindrical anode, an annular projection extending from the inner surface of said cylindrical anode toward said conical cathode but terminating with a spacing therefrom, an insulating film coated on the outer surface of said conical cathode while leaving a conductive emission ring surface facing the termination of said annular projection, and a solenoid coil mounted on said vacuum container and adapted to produce a uniform magnetic field in said vacuum container in parallel to the axis of said conical cathode, said conical cathode having an inclined surface defining an angle of 1 to 15 degrees relative to the axis thereof, said cold-cathode magnetron injection gun being adapted to operate under conditions of $\alpha_0 \leqq 0.1$, $\alpha_0 = E_0/(cB)$, $E_0$ being the electric field intensity at said emission ring surface, c the velocity of light in vacuum, and B the magnetic flux density of said magnetic field.

In a preferred embodiment of the invention, the emission ring surface of the cold-cathode is a metallic surface with undulations.

BRIEF DESCRIPTION OF THE DRAWINGS

For a better understanding of the invention, reference is made to the accompanying drawings, in which.

Throughout different views of the drawings, 1 is a vacuum container, 2 is a central conductor, 3 is a cathode, 3A is an emission ring surface, 3B is an insulating film, 4 is an anode, 4P is an annular projection, 5 and 5' are insulating holders, 6 is a lead wire, 7 is a vacuum pump, 8 is a Marx generator, 9 is an air gap, 10 and 11 are resistances, 12 is a solenoid coil, 13 is a beam counter, 14 is a Faraday cup, 15 is an O ring, and 16 is an insulating plug.

DESCRIPTION OF THE PREFERRED EMBODIMENT

Figure 1:
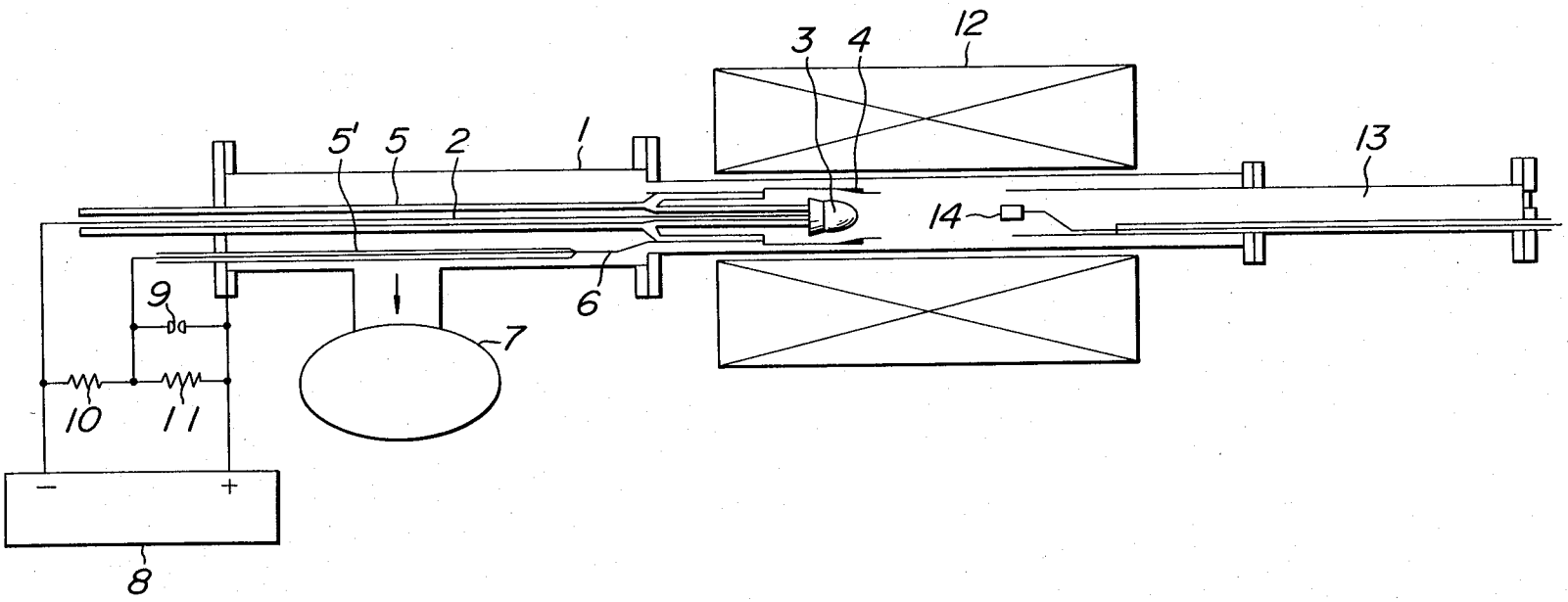
FIG. 1 is a schematic view of a cold-cathode magnetron injection gun according to the present invention to which electron beam measuring devices are connected.

In FIG. 1, devices for measuring electron beams are mounted on a cold-cathode magnetron injection gun of the invention, so as to prove the theory of the invention by measuring the electron beam generated by the magnetron injection gun. Referring to FIG. 1, a vacuum container 1 holds a central conductor 2 sealed therein. A conical cathode 3 is secured to the inner end of the central conductor 2 while a cylindrical anode 4 coaxially surrounds the conical cathode 3 with a spacing therefrom. An insulating holder 5, secured to a sidewall of the vacuum container 1, extends to the inside of the container 1 and holds the cathode 3 at the central portion of the inner end thereof, and the cylindrical anode 4 is secured to the peripheral portion of the inner end of the insulating holder 5. The central conductor is airtightly sealed in the insulating holder 5, so as to extend from the outer surface of the vacuum holder 1 to the cathode 3. Another insulating holder 5' is secured to the sidewall of the vacuum container 1 so as to carry a lead wire 6 airtightly sealed therein. The lead wire 6 electrically connects the cylindrical anode 4 to the outside of the vacuum container 1. The insulating holders 5 and 5' can be made of glass or other suitable ceramic material. A vacuum pump 7 extracts air from the inside of the vacuum container 1. A Marx generator 8 has output terminals connected to a serial circuit of resistances 10 and 11, and an air gap 9 is connected across the resistance 11. The central conductor 2 is connected to that terminal of the Marx generator 8 which is connected to the resistance 10, while the lead wire 6 is connected to the joint between the resistances 10 and 11. A solenoid coil 12 is mounted on the vacuum container 1 in such a manner that, when energized, the solenoid coil 12 produces a magnetic field in the vacuum container 1 in parallel with the axis of the cathode 3. A beam counter 13 is mounted on the vacuum container 1 so as to face the cathode 3 and the anode 4, and a Faraday cup 14 is mounted on that end of the beam counter 13 which is closest to the cathode 3 and the anode 4.

Figure 2:
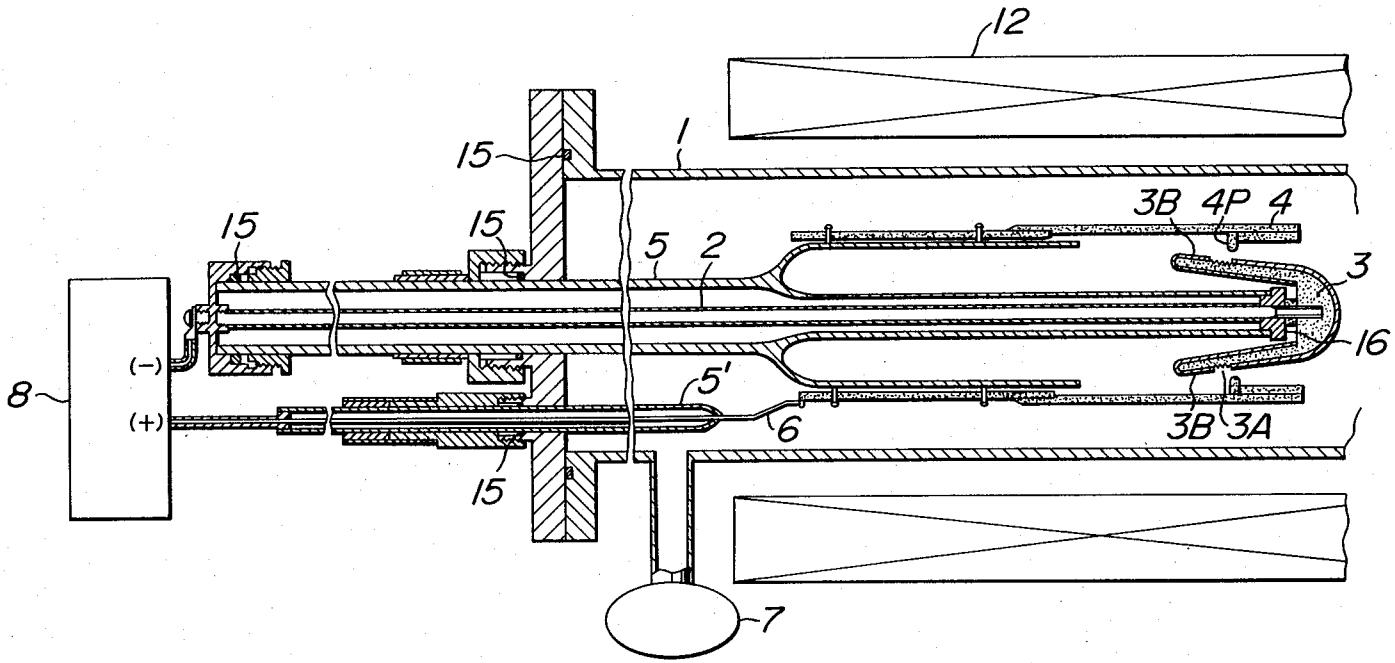
FIG. 2 is an enlarged view of an essential portion of the magnetron injection gun of FIG. 1.

FIG. 2 shows the magnetron injection gun of FIG. 1 on a larger scale. Although the conventional foil-less REB diode uses a pulse shaping line, the present invention does not use any pulse shaping line in order to get a longer pulse duration. In the invention, the output from the Marx generator 8 is divided at a ratio of 10:1 by the induction-free resistances 10 and 11, and the larger portion of the divided output is applied across the cathode 3 and the anode 4, while the smaller portion of the divided output is applied across the anode 4 and the vacuum container 1. If no voltage is applied across the anode 4 and the vacuum container 1, a virtual cathode is formed in the beam passage, so that the extraction of the electron beam becomes difficult. The function of the air gap 9 connected across the resistance 11 or across the anode 4 and the vacuum container 1 is that, when the anode 4 is shorted to the cathode 3 by plasma, the air gap 9 prevents insulation breakdown between the anode 4 and the vacuum container 1 due to the negative high potential applied to the anode 4. Thus, the air gap 9 is adjusted so as to fire when about 20 kV is applied thereacross, so as to short the space between the anode 4 and the vacuum container 1. When the space between the cathode 3 and the anode 4 is short-circuited, generation of the electron beam is interrupted, and the flashing or firing noise at the air gap 9 gives an alarm of such short-circuit. In the electron beam measuring device used in the experiments of the present invention, three Rogowsky coils (not shown) were included to measure the cathode current, the anode current, and the electron beam current.

In the illustrated embodiment of the invention, the conical cathode 3 is made of aluminum, and an insulating film 3B such as alumite (trademark) is coated on the surface of the cathode 3. The axis of the conical cathode 3 is aligned with the axis of the central conductor 2 in this embodiment, and the inclined surface of the conical cathode 3 makes an angle $\phi$ relative to the axis of the central conductor 2. The apex of the conical cathode 3 extends away from the central conductor 2. At an intermediate portion of the inclined surface of the conical cathode 3, the insulating film 3B is removed so as to expose the annular metallic surface of the cathode 3 which forms an emission ring surface 3A for emitting electrons. Preferably, the emission ring surface 3A is a bare metallic surface with undulations as shown in FIG. 2. An annular projection 4P extends from the inner surface of the cylindrical anode 4 and terminates with a spacing from the thus formed emission ring surface 3A of the cathode 3. A high voltage gradient of about 100 kV/cm is applied across the annular projection 4P of the anode 4 and emission ring surface 3A of the conical cathode 3 from the Marx generator 8 through the central conductor 2 carried by the insulating holder 5 and the lead wire 6 carried by the other insulating holder 5'.

In FIG. 2, O rings 15 airtightly seal the inside of the vacuum container 1 from the outside thereof at the joints between the vacuum container 1 and the insulating holder 5 and between the insulating holder 5 and the central conductor 2. An insulating plug 16 such as a Derlin (trademark) plug seals another joint between the central conductor 2 and the insulating holder 5.

To cause field emission in the cold-cathode magnetron injection gun according to the present invention, an electric field with an intensity of 100 kV/cm or higher must be applied. On the other hand, in practice, there is a limit in the intensity of the static magnetic field to be applied, and a magnetic flux density of 9.4 kG or less is used in an embodiment of the present invention. Thus, the shape of the electrode and the values of the electric and magnetic field intensities must be designed in such a manner that the field emission of electrons is caused and the electrons thus emitted can be used as a beam without allowing the electrons to strike the anode.

The relativistic motion equation of a single electron is given by $$\left.\begin{aligned} \frac{d}{dt}(m\vec{v}) &= -e(\vec{E} + \vec{v} \times \vec{B}) \\ m &= m_0(1 - v^2/c^2)^{-\frac{1}{2}} \end{aligned}\right\} \quad \ldots (1)$$

here, $\vec{E}$: electric field intensity,
$\vec{B}$: magnetic flux density,
$m_o$: static mass of the electron,
c: the speed of light in vacuum,
$\vec{v}$: velocity vector of the electron,
v: absolute value of the electron velocity vector,
e: electric charge of the electron, and
t: time.

One can derive the following set of equations (2) from the set of equations (1) by decomposing the vector quantity into the three components of an orthogonal coordinate system and further converting them into those of a cylindrical coordinate system.

$$\left.\begin{aligned} \frac{d}{dt}[v_r(1 - v^2/c^2)^{-\frac{1}{2}}] - v_\theta(1 - v^2/c^2)^{-\frac{1}{2}}\frac{d\theta}{dt} &= \\ -\frac{e}{m_0}(E_r + v_\theta B_z - v_z B_\theta) \\ \frac{d}{dt}[v_\theta(1 - v^2/c^2)^{-\frac{1}{2}}] + v_r(1 - v^2/c^2)^{-\frac{1}{2}}\frac{d\theta}{dt} &= \\ -\frac{e}{m_\theta}(E_\theta + v_z B_r - v_r B_z) \\ \frac{d}{dt}[v_z(1 - v^2/c^2)^{-\frac{1}{2}}] &= \\ -\frac{e}{m_0}(E_z + v_r B_\theta - v_\theta B_r) \end{aligned}\right\} \quad \ldots (2)$$

Figure 3:
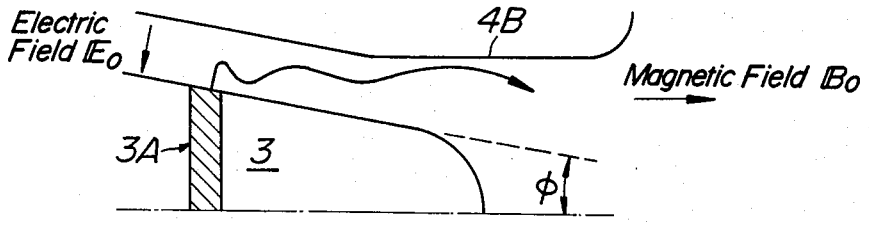
FIG. 3 is an explanatory diagram of the principle of the present invention, showing three zones of the cathode having different electric field intensities.

The shape of the electron gun is assumed to be symmetrical with respect to its own longitudinal axis as shown in FIG. 3. To provide a large diode impedance, a uniform magnetic field is applied in the above-mentioned longitudinal axial direction. The electric field $\vec{E}$ and the magnetic flux density $\vec{B}$ in terms of the cylindrical coordinates (r, $\theta$, z) are given by $\vec{E}=(-E_0\cos\phi, 0, -E_0\sin\phi)$ and $\vec{B}=(0, 0, B_0)$; wherein $E_0$ is the absolute value of the electric field applied, $B_0$ is the absolute value of the magnetic flux density applied, and $\phi$ is the inclination of the electrode plane relative to the above-mentioned longitudinal axis. For simplicity, the value of the electric field $E_0$ in vacuum and an initial zero velocity of the electrons are assumed. With the foregoing assumptions, the trajectories and energy of electron beams were numerically calculated by solving the set of equations (2) by the Runge-Kutta-Gill method.

Figure 4A:
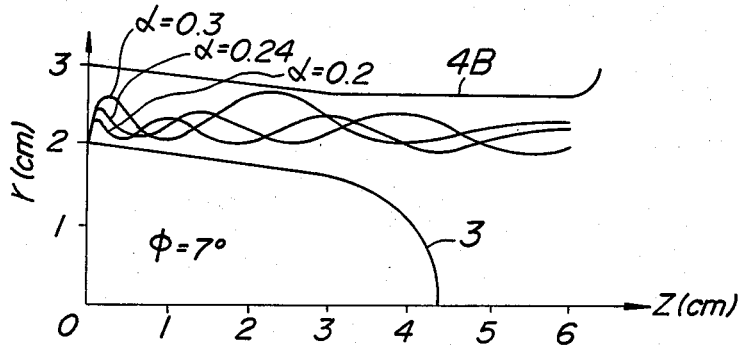
FIG. 4A, FIG. 4B, and FIG. 4C are curves showing electron beam trajectories in the case of parallel electrodes.
Figure 4B:
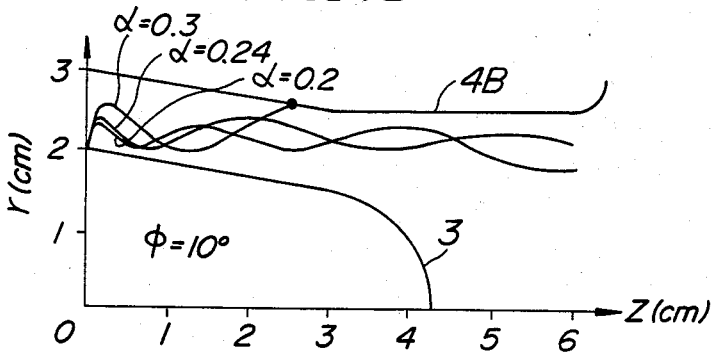
Figure 4C:
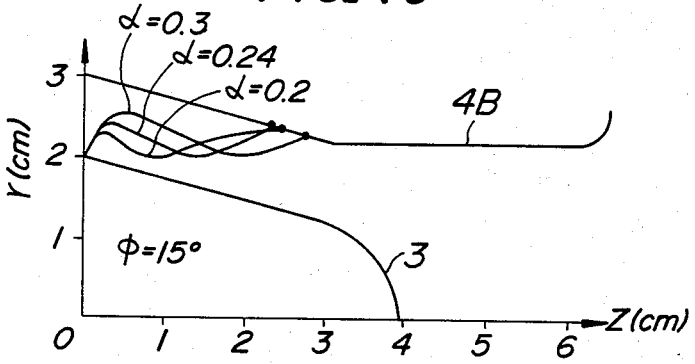

FIGS. 4A through 4C show beam trajectories which are determined by calculation while assuming the parallel disposition of the anode and the cathode (to be referred to as "parallel electrodes", hereinafter) as shown in FIG. 3. In the figures, the parameter $\alpha$ is given by $$\alpha = E_o/cB_0$$

here, $E_0$: electric field intensity between the electrodes at parallel portions thereof, c: velocity of light (a constant), and $B_0$: magnetic flux density which is constant in the axial direction.

The parameter $\alpha$ represents the degree of dominance of the electric field over the magnetic field, and when the value of the parameter $\alpha$ is sufficiently large, the electrons move as if there were only the electric field. To extract the electrons as the electron beams, the parameter $\alpha$ must be less than unity, i.e., $\alpha < 1$. Since the initial velocity of the electrons is assumed to be zero, one trajectory is determined for a given combination of the parameter $\alpha$ and the angle $\phi$. The beam trajectories are three-dimensional, and the trajectories propagate in the Z-axis direction while being drifted in the $\phi$ direction. FIGS. 4A through 4C show the trajectory loci on two-dimensional planes including the Z-axis and the R-axis. In the case of $\theta = 10°$, when the parameter $\alpha$ increases to $\alpha = 0.3$, the electron beams strike the anode, while in the case of $\theta = 15°$, the electron beams strike the anode even at $\alpha = 0.2$. Accordingly, the angle $\phi$ and the parameter $\alpha$ must be smaller than certain values.

The relativistic kinetic energy U of individual electrons in the beam is given by $$U = (m - m_0)c^2 \quad (3)$$
$$= m_0c^2\{(1 - v^2/c^2)^{-\frac{1}{2}} - 1\}$$

Figure 5A:
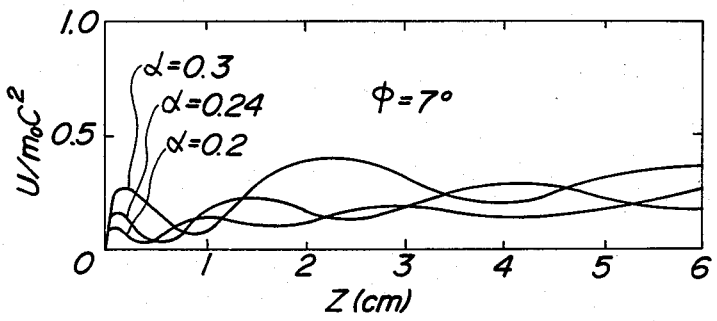
FIG. 5A, FIG. 5B, and FIG. 5C are graphs showing electron beam energies and electron energy characteristics in the case of parallel electrodes.
Figure 5B:
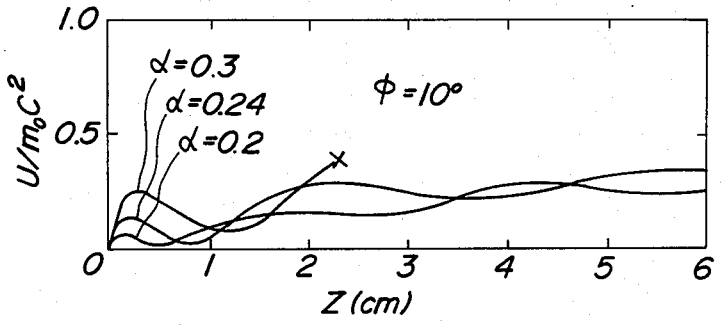
Figure 5C:
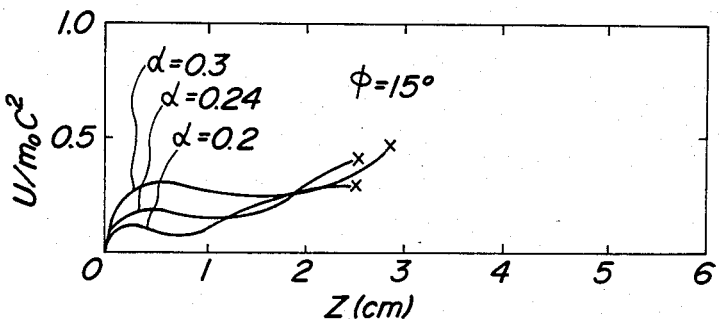

FIGS. 5A through 5C show such kinetic energies for the cases shown in FIGS. 4A through 4C. The ordinates of FIGS. 5A through 5C are normalized by dividing the energy U by a quantity $m_0c^2$. The cross marks (X) in the figures indicate that the electron beams strike the anode. Since the kinetic energy of the electrons is obtained solely from the electric field, in order to increase the electron beam energy, the electron beams have to be brought close to the anode, but such movement of the electron beams inevitably tends to cause more frequent striking of the anode by the electron beams. As can be seen from FIGS. 4A through 4C and FIGS. 5A through 5C, the kinetic energy of the electrons increase with the increase of the angle $\phi$ and the parameter $\alpha$, but electrons with too much kinetic energy strike the anode and cannot be used as the electron beams. Judging from the above, the preferable conditions appear to be $\phi = 7°$ and $\alpha \leqq 0.24$. Besides, if the electron-emitting surface 3A is made in a ring form with a narrow width, the thermal spread of the beam speeds obtained becomes small, so that when it is used in relativistic electronic devices, a high efficiency can be expected.

Figure 6:
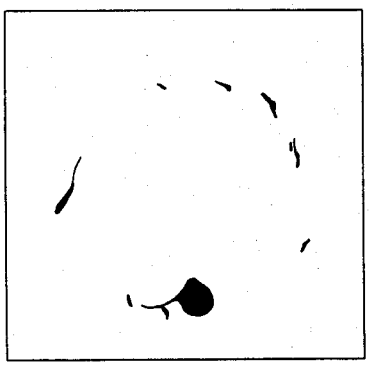
FIG. 6 is a schematic illustration of the cross-sectional configuration of an electron beam in the case of parallel electrodes.
Figure 7:
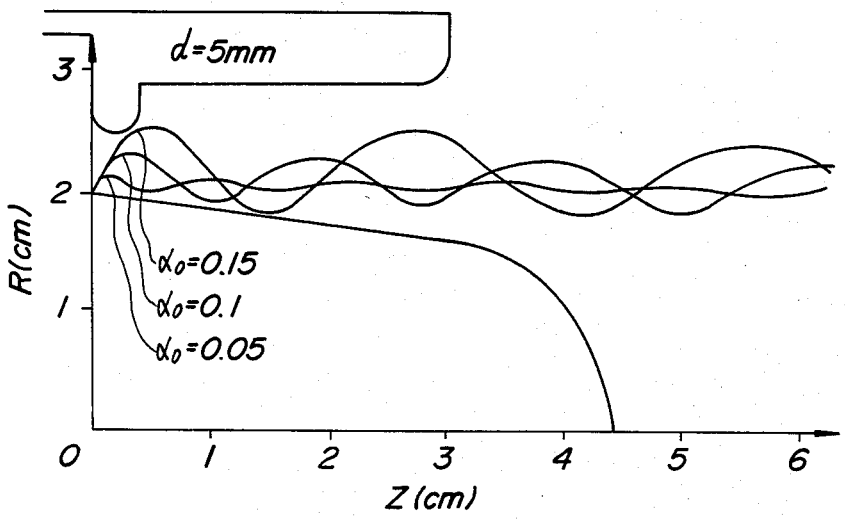
FIG. 7 is a curve showing electron beam trajectories in the case of using an anode with an annular projection according to the present invention.
Figure 8:
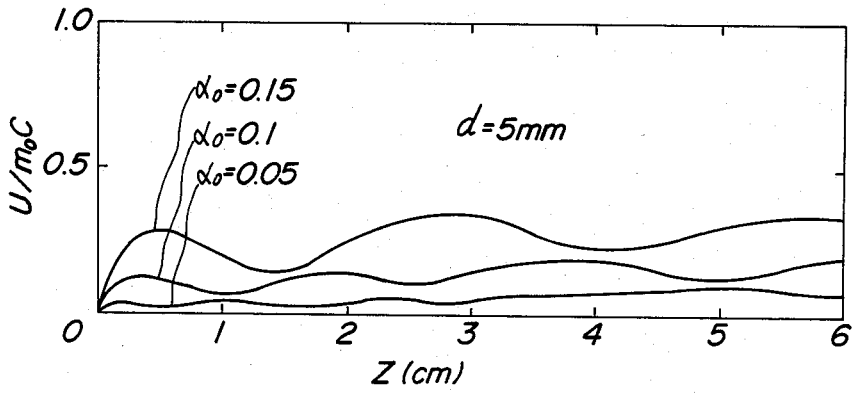
FIG. 8 is a graph showing electron beam energy characteristics in the case of using the anode with an annular projection according to the present invention.
Figure 9:
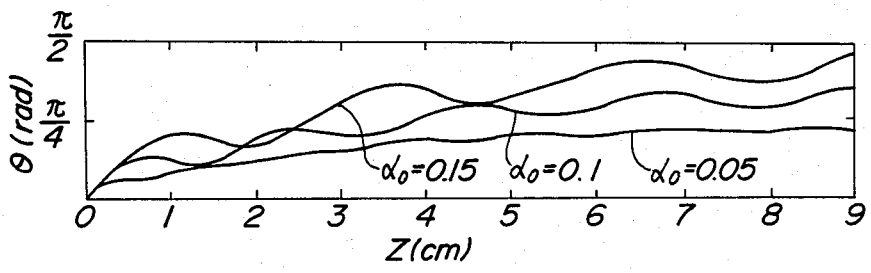
FIG. 9 is a graph showing the displacement of the electron beam trajectory in the circumferential or $\theta$ direction in the magnetron injection gun of the present invention.

Based on the above, tests were made by preparing the above-mentioned parallel electrodes with the angle $\phi$ of 7°. In the tests, a phenomenon that the electron beams were concentrated at a certain portion due to the non-uniformity of the spacing between the electrodes or the like was noted as shown in FIG. 6 and will be described hereinafter. To avoid this difficulty, the inventors devised an annular projection extending from the anode toward the cathode, so as to intensify the electric field in the proximity of the electron-emitting surface, as shown in FIG. 7. A series of numerical calculations were carried out for different configurations of the annular projection of the anode. In FIG. 7, $\alpha_0$ shows the value of the parameter $\alpha$ at positions where the electric field intensity is the highest, and d represents the distance between the extended tip of the annular projection of the anode and the cathode. The curves of FIG. 7 show the result of a calculation for the case of d=5 mm, in which the best result of the tests was achieved. FIG. 7 shows the trajectories on the R-Z plane, while FIG. 9 shows the trajectories on the $\theta$-Z plane. FIG. 8 shows the kinetic energy U of the electrons for the case of FIG. 7. In the case of $\alpha_0 = 0.15$, the ultimate value of $U/m_0c^2$ was about 0.4, and the velocity of the electron under such conditions was about 70% of the velocity of light. As the electron moved in the Z-axis direction, the electric field intensity was reduced, and when the Z-axis coordinate exceeded 10 cm, the drift in the $\theta$ direction disappeared and the electron moved through a uniform magnetic field. As can be seen from FIG. 9, the rotation of the electron by that time was, for instance, in the case of $\alpha_0 = 0.15$, about 160° in the clockwise direction as seen toward the moving direction of the electron.

Figure 10:
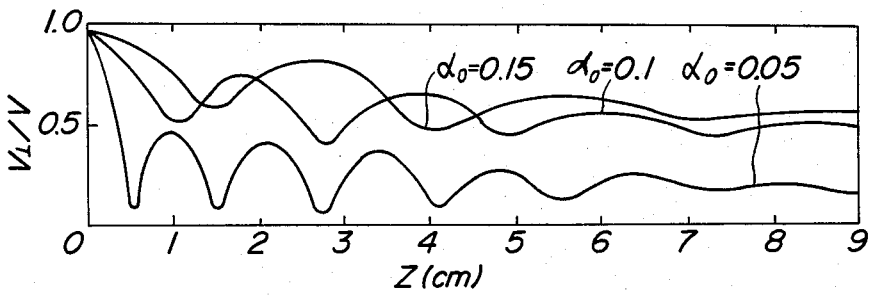
FIG. 10 is a graph showing the speed components in a direction perpendicular to the Z-axis in the magnetron injection gun of the present invention.

FIG. 10 shows the variation of the ratio of the electron speed component $v_\perp$ in the direction perpendicular to the Z-axis to the absolute value v of the electron speed at different Z-axis coordinates. Such ratio represents the value of sin $\delta$, $\delta$ being the angle between the moving direction of the electron and the Z-axis. As can be seen from FIG. 10, the speed component in the perpendicular direction increases with the increase of the $\alpha_0$ value. On the contrary, the ultimate value of the ratio $v_\perp/v$ can be adjusted by modifying the value of $\alpha_0$. In the case of relativistic electron beams (REB) used in gyrotrons and free electron masers, it is very important to minimize the thermal spread of the electron speed component $v_\perp$ and to have the electron speed component $v_\perp$ controllable, from the standpoint of improving the oscillation efficiency.

FIG. 6 shows a cross-sectional configuration of an electron beam generated by the parallel disposition of the electrodes as shown in FIG. 4. The cross-sectional configuration of FIG. 6 was measured at right angles to the direction of the electron beam, by placing a heat sensitive member such as a thin titanium sheet or a heat sensitive printing paper in front of the Faraday cup 14 of FIG. 1. The distance between the anode 4 and the cathode 3 parallel thereto was 10 mm, and the heat sensitive member was placed at a position 14 cm away from the electron emitting portion so as to measure the cross-sectional configuration of the electron beam. The voltage applied across the electrodes was 121 kV and the magnetic field in the axial direction was 9 kG, with $\alpha = 0.045$. The reason why the electron beam was concentrated into a spot seemed to be because unevenness in the distance d between the electrodes was inevitable, and that the electric field intensity applied was not necessarily sufficient for causing electron emission. To eliminate such undesired concentration of the electron beam, increase of the voltage applied across the electrodes and the reduction of the distance d between the electrodes can be considered. However, such increase of the voltage and the reduction of the electrode-to-electrode distance may result in an increased tendency of the electron beam to collide with the anode and cause difficulty in preventing deterioration of the insulation.

Figure 11:
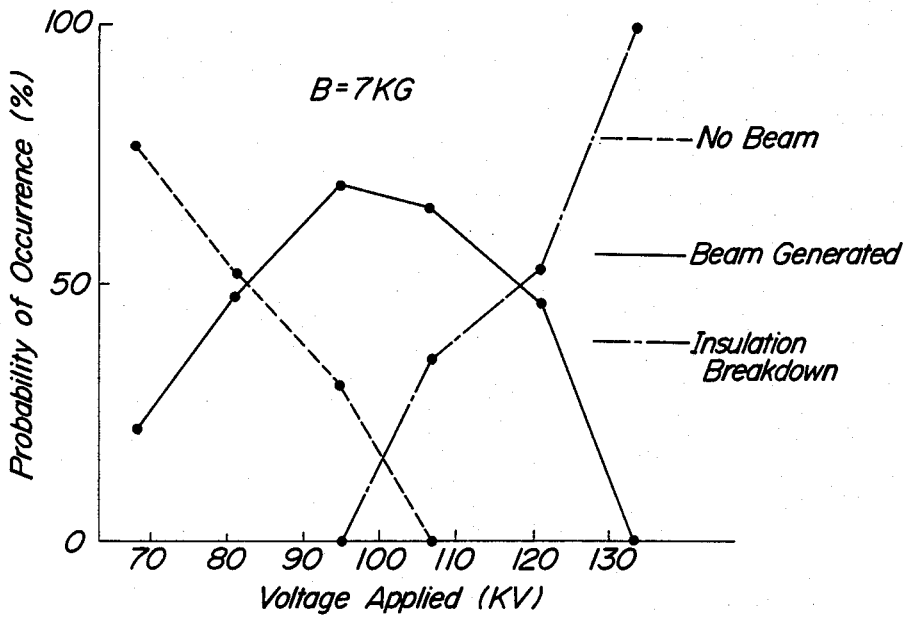
FIG. 11 is a graph illustrating the relationship between the voltage applied and the response of the magnetron injection gun of the present invention, such as the probability of electron beam generation, in the case of a magnetic field intensity of 7 kG.

FIG. 11 shows the relation between the voltage applied and the probability of electron beam generation in the case of the magnetic field B of 7 kG, as determined statistically by using a large number of discharges. As shown in FIG. 11, the application of a voltage of about 100 kV was most suitable for generation of an electron beam. In this cse, $\alpha_0$ was about 0.1. Under the optimal conditions, the probability of the electron beam generation was about 70% and the reproducibility was not necessarily very high, partly because a cold cathode was used. As can be seen from FIG. 7, the value of $\alpha_0$ may be as high as $\alpha_0=0.20$ provided that a suitable design of the magnetron injection gun is adopted, but only about one half of the experiment tried have been successful. The reason for the limited success seems to be in that the experimental design neglected the space charge effect, but in practice, the space charge effect tends to cause the electrons to collide with the anode.

Figure 12A:
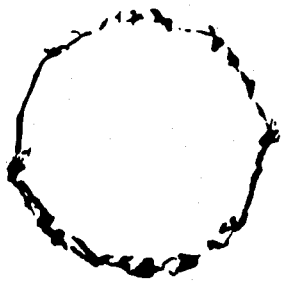
FIG. 12A and FIG. 12B are diagrammatic illustrations, showing the variation of the cross-sectional configuration of the electron beam with the variation of the magnetic field intensity in the magnetron injection gun of the invention.
Figure 12B:
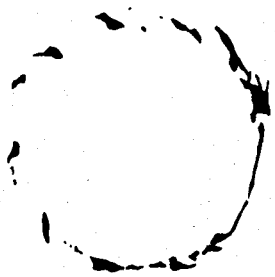

FIG. 12A and FIG. 12B show the cross-sectional configurations of electron beams in the case of an anode-to-cathode distance d=5 mm and a magnetic field of 9 kG and 7 kG. In the two figures, the parameters other than the magnetic field were the same, and the voltage applied across the anode 4 and the cathode 3 was 95 kV, and the number of shots was three, while the distance from the electron emitting surface to the position of the heat sensitive member was 24 cm. FIG. 12A and FIG. 12B show that, with the reduction of the magnetic field, the intensity of the electron beam was reduced. The reason for it has two aspects; namely, one aspect is that the weak magnetic field increases the parameter $\alpha_0$ to increase the probability of the electron collision with the anode 4 so as to reduce the beam current, and the other aspect is that the electron beam is diverged to reduce the current density. Since the configuration of the magnetic lines of force is independent of the magnitude of the electric current through the solenoid coil 12, the diameter of the annular beams is constant; in fact the inner diameters of the annular beams of FIG. 12A and FIG. 12B were both 37 mm.

Figure 13:
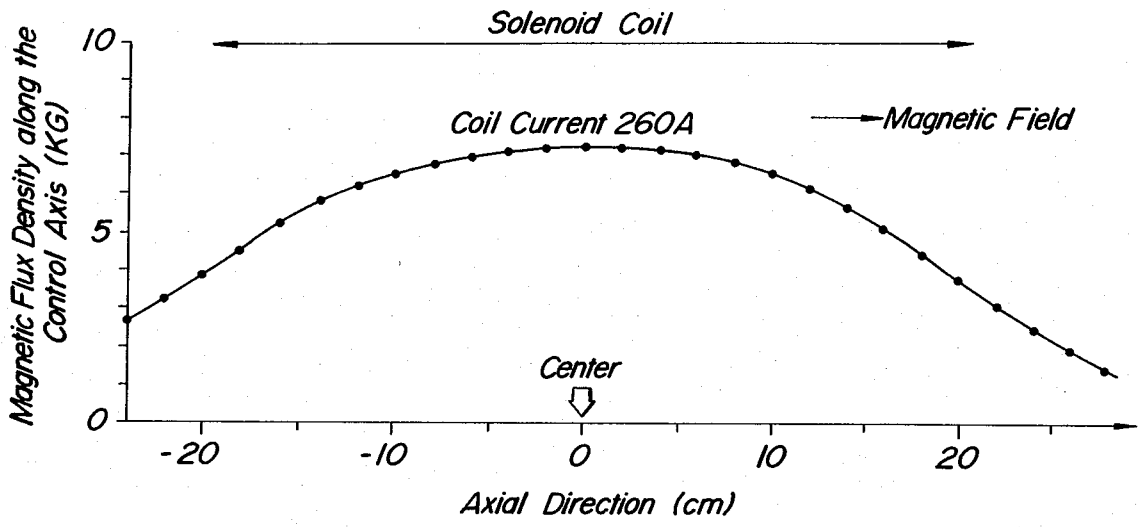
FIG. 13 is a graph, showing the distribution of the magnetic field intensity in the magnetron injection gun of the present invention.

FIG. 13 shows the measured distribution of the magnetic flux density along the central axis of the solenoid coil 12 of the magnetron injection gun of the present invention. The measurements were taken by using a gauss meter under the following conditions.

Magnetic field in the axial direction: 9 kG
Solenoid coil current: 260 A
Duration: 2 sec.

In the figure, the position along the central axis is represented on the abscissa, while the magnetic flux density (kG) along the central axis is represented on the ordinate. The arrow in FIG. 13 shows the position of the center of the solenoid coil 12.

Figure 14:
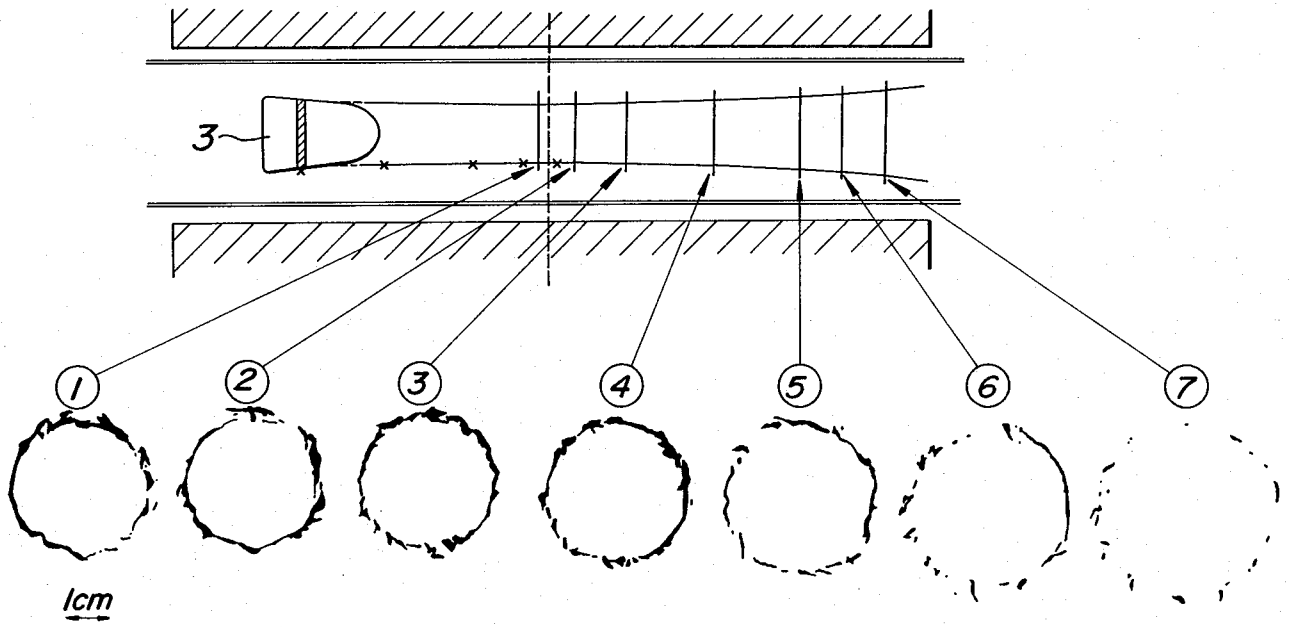
FIG. 14 is a schematic diagram showing the cross section of the electron beam at different positions in the magnetron injection gun of the present invention.

FIG. 14 shows the cross-sectional configurations of an electron beam generated by the magnetron injection gun according to the present invention, taken at different positions along the central axis. The measurements were taken by changing the position of the heat sensitive member, so as tc check the variation of the cross-sectional configuration of the electron beam. Since the heat sensitive member had to be replaced after each measurement, the vacuum container 1 was opened for each measurement. In FIG. 14, the voltage applied was 95 kV, and the magnetic field in the axial direction was 9 kG, and the electron beam was generated three times for measurement at each position for exposing the heat sensitive member to the electron beams.

The measured values of FIG. 14 indicate that annular electron beams with substantially uniform cross-sectional configuration were generated. When the magnetic field is sufficiently high, the electron beam appears to proceed substantially along the magnetic lines of force. Since the magnetic lines of force are likely to be symmetrical with respect to the longitudinal center of the solenoid coil 12, the electron beam trajectory can be traced to the proximity of the electron emitting surface 3A by using such symmetrical properties of the magnetic lines of force. In FIG. 14, the diameters of the electron beam at the positional 1 through 7 were determined by measuring the inner diameters of the pictures taken by the heat sensitive members at the corresponding positions. The dotted line in the figure indicates the position of a plane through the longitudinal center of the solenoid coil 12, and the cross marks (X) indicate that the diameters at the points 1 through 5 were transferred to the crossed points by assuming the above-mentioned symmetry relative to the plane of the dotted line. When the inner edge diameter of the annular electron beam was traced toward the inside of the magnetron injection gun, it turned out to be substantially the same as the diameter of the electron emitting surface. It is noted that slight concentrations of electron beams occurred at certain locations of the annular electron beam, and the locations of such concentrations were the same at each shot. The concentrations appeared to be due to the uneven small projections on the electron emitting surface.

Figure 15A:
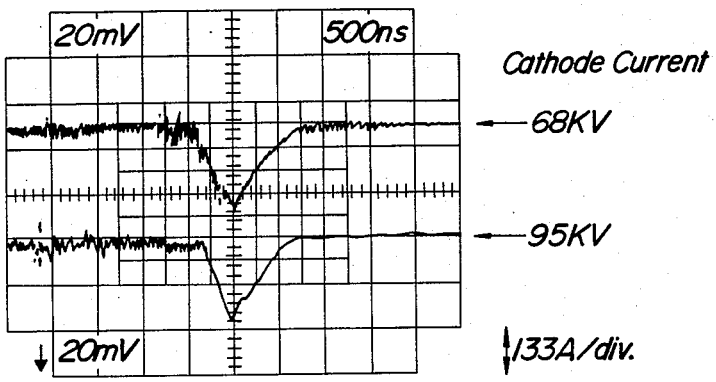
FIG. 15A, FIG. 15B and FIG. 15C show typical waveforms of the cathode current, the anode current and the beam current in the magnetron injection gun of the present invention.
Figure 15B:
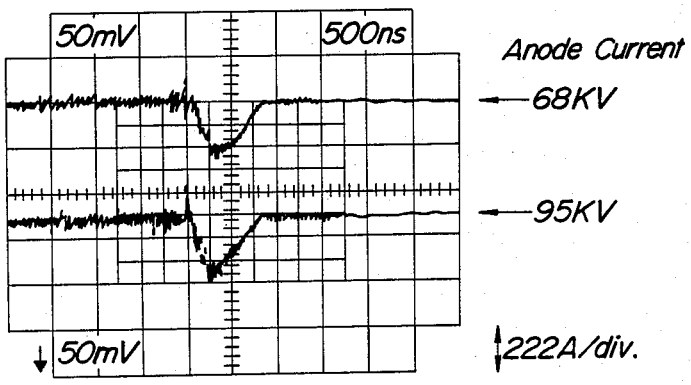
Figure 15C:
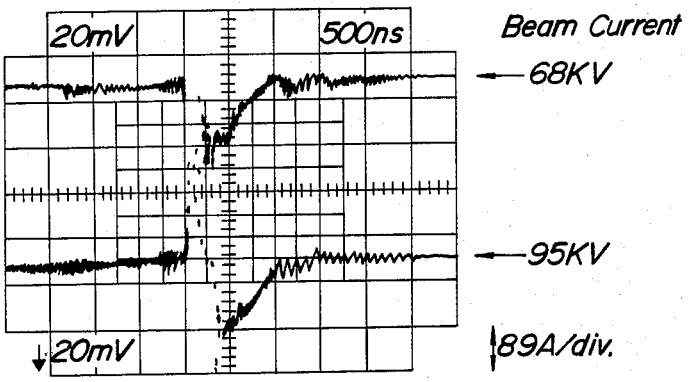

FIGS. 15A, 15B and 15C show typical waveforms of the cathode current, the anode current, and the beam current in the magnetron injection gun of the present invention. The measurements were taken under the conditions of the axial magnetic field of 9 kG, the voltage applied across the anode 4 and the cathode 3 at 68 kV and 95 kV. Since the sensitivities of Rogowsky coils used in the measurements were different, the absolute values of the illustrated waveforms cannot be compared directly, but the patterns of the three currents were substantially similar. More particularly, they rise linearly at about 400 nsec and substantially linearly fall at 600 nsec thereafter. The oscilloscope used was a memory scope with one beam, so that simultaneous measurement of different currents was not possible, and the illustrated waveforms were measured by using different shots. Strictly speaking, there were time differences among such waveforms but if one considers the fact that the electron speed was several tens of percent of the speed of light, the measured values could be treated as taken substantially at the same instant. The similarity of the illustrated waveforms indicates that the rate at which the electrons emitted from the electron emitting surface strike the anode does not vary much as time elapses.

Table 1 shows the result of tests on electron beam generation by using different magnetic field intensities and different voltages applied across the anode and the cathode, in which the electron beams were generated several times for each test conditions, and the averages of the measured values were determined as listed. When the axial magnetic field is sufficiently high for eliminating the collision of electrons with the walls of the vacuum container, the cathode current should correspond to the sum of the beam current and the anode current, but the values in the Table 1 represent averages from different shots, so that there are certain discrepancies. The test results indicated that the beam generating efficiency in terms of the ratio of the electron beam current to the cathode current was about 40%, or about 40% of the cathode current was extracted as the electron beam current.

The cross-sectional configurations of the electron beam measured by heat sensitive members showed slight concentrations of currents, and the current density should be considered to vary from place to place. Nevertheless, overall mean current densities for the electron beams were determined. For instance, the areas of the colored portions of the picture taken in the proximity of the center of the coil 12 were found to be 180 $mm^2$ for the case of the applied voltage of 95 kV and the magnetic flux density of 9 kG. The beam current for this case was 137A, so that the overall average current density of the electron beam was 0.77 $A/mm^2$. Such level of the overall average current density is hard to obtain by using a conventional hot-cathode magnetron injection gun. It was confirmed by small Faraday cups that the portions corresponding to non-colored parts of the heat sensitive member did not carry any current.

As described in the foregoing, the cold-cathode magnetron injection gun according to the present invention produces an electron beam whose properties are between those obtained by a conventional hot-cathode magnetron injection gun and those obtained by the well-known foil-less REB diode, as summarized in the following Table 2.

TABLE 1

| Magnetic field (KG) | Voltage applied (kV) | Cathode current (A) | Beam current (A) | Anode current (A) | Beam current/ Cathode current (%) |
|---|---|---|---|---|---|
| 7 | 95 | 325 | 125 | 215 | 38.5 |
| | 107 | 308 | 131 | 243 | 42.5 |
| | 121 | 358 | 113 | 275 | 31.6 |
| 9 | 95 | 385 | 137 | 249 | 35.6 |
| | 107 | 389 | 137 | 244 | 35.2 |
| | 121 | 396 | 153 | 261 | 38.6 |

TABLE 2

| Gun | Pulse duration | Electron beam current |
|---|---|---|
| Hot-cathode magnetron injection gun | 1 msec or longer (long) | 1 A or smaller (small) |
| Foil-less REB diode | 100 nsec or shorter (short) | 1 kA or larger (large) |
| Cold-cathode magnetron injection gun | Between 1 μsec and 1 msec (medium) | Between 100 A and 1 kA (medium) |

Gyrotrons using the conventional hot-cathode magnetron injection guns are on the market. If the cold-cathode magnetron injection gun of the present invention is used, an annular electron beam with a beam current of 100 to 500 A or more, which is at least ten to one hundred times that obtained by the hot-cathode magnetron injection gun, is obtained.

Comparing with the conventional foil-less REB diode, the cold-cathode magnetron injection gun of the present invention can produce beamed electrons with a beam energy of higher than 100 keV and a duration of several microsecond, which duration is more than one hundred times that obtained by the foil-less REB diode. Accordingly, the cold-cathode magnetron injection gun of the present invention can be used in various new applications including high-power X-ray generators, high-power millimeter wave oscilators, high-intensity laser beam generators, beams for generation of high-power neutron beam, ion accelerators, or the like.

The relativistic electron beams generated by the cold-cathode magnetron injection gun of the present invention can be used in nuclear fusion, for instance, as guns for heating of and injection for linear plasma generation, as REB ring beams for inverse magnetic field orientation for stabilizing plasma, and the like. Thus, the present invention contributes greatly to the industry.

Although the invention has been described with a certain degree of particularity, it is understood that the present disclosure has been made only by way of example and that numerous changes in details of construction and the combination and arrangement of parts may be resorted to without departing from the scope of the invention as hereinafter claimed.

What is claimed is:

1. A cold-cathode magnetron injection gun, comprising a vacuum container;

an insulating holder, said insulating holder extending from a sidewall of said vacuum container toward the inside thereof;

a conductor airtightly secured to said insulating holder, said conductor extending from a voltage source outside said vacuum container to the inner end of said insulating holder;

a conical cold-cathode having a longitudinal axis secured to the inner end of said insulating holder and connected to the inner end of said conductor, the apex of said conical cathode extending away from said conductor;

a cylindrical anode secured to said insulating holder, said cylindrical anode coaxially surrounding said conical cathode;

a lead wire connecting said cylindrical anode to said voltage source;

an annular projection extending from the inner surface of said cylindrical anode toward said conical cathode, an end of said annular projection being spaced from said conical cathode;

an insulating film coated on a portion of the outer surface of said conical cathode, the portion of the outer surface of said conical cathode not coated by said insulating film forming a conductive emission ring surface facing the end of said annular projection; and a solenoid coil surrounding said vacuum container, said solenoid coil generating a uniform magnetic field within said vacuum container extending parallel to the axis of said conical cathode, said conical cathode having an inclined surface defining a magnetron injection gun adapted to operate under conditions of $\alpha_0 \leqq 0.1$, where $\alpha_0 = E_0/(cB)$, $E_0$ is the electric field intensity at said emission ring surface, c the velocity of light in vacuum, and B the magnetic flux density of said magnetic field.

2. A cold-cathode magnetron injection gun as set forth in claim 1, wherein said emission ring surface is a metallic surface having undulations.

3. A cold-cathode magnetron injection gun as set forth in claim 1, wherein said magnetron injection gun generates a cylindrical electron beam with an electron density of more than 100 $A/cm^2$ of short duration around the axis of said conical cathode.

* * * * *